US007063155B2

(12) United States Patent
Ruttley

(10) Patent No.: US 7,063,155 B2
(45) Date of Patent: Jun. 20, 2006

(54) CASING CUTTER

(75) Inventor: David J. Ruttley, Marrero, LA (US)

(73) Assignee: Deltide Fishing & Rental Tools, Inc., Harvey, LA (US)

( * ) Notice: Subject to any disclaimer, the term of this patent is extended or adjusted under 35 U.S.C. 154(b) by 241 days.

(21) Appl. No.: 10/742,177

(22) Filed: Dec. 19, 2003

(65) Prior Publication Data

US 2005/0133224 A1 Jun. 23, 2005

(51) Int. Cl.
*E21B 29/10* (2006.01)

(52) U.S. Cl. ..... 166/298; 166/55.7; 175/265
(58) Field of Classification Search ..... None
See application file for complete search history.

(56) References Cited

U.S. PATENT DOCUMENTS 4,938,291 A * 7/1990 Lynde et al. ..... 166/55.8
5,735,359 A * 4/1998 Lee et al. ..... 175/269
5,791,409 A * 8/1998 Flanders ..... 166/55.8
5,899,268 A * 5/1999 Lynde et al. ..... 166/55.6
6,357,528 B1 * 3/2002 Davis et al. ..... 166/339

FOREIGN PATENT DOCUMENTS

GB 2352747 A * 2/2001

* cited by examiner

*Primary Examiner*—Zakiya W. Bates
(74) *Attorney, Agent, or Firm*—Keaty Professional Law Corporation

(57) ABSTRACT

Casing cutter for severing multiple tubulars in a well bore has a pair of cutter blades pivotally mounted on a support body. The blades are pivotally mounted for gradual movement outside of the support body when downward force is applied to proximate ends of the cutter blades. The support body is rotated inside the innermost of the multiple tubulars, while the cutter blades sever the tubulars of progressively increasing diameter.

24 Claims, 6 Drawing Sheets

CASING CUTTER

FIELD OF THE INVENTION

The present invention relates to the field of gas and petroleum exploration and production and, more particularly, to an apparatus for cutting multiple tubulars, such as casings in a well bore.

BACKGROUND OF THE INVENTION

In the offshore industry, the exploration and production of gas and petroleum is conducted through tubulars of various diameters that are cemented inside each other and extend to a distance below the sea floor, where the production zone is located. When the well is abandoned, the owner of the offshore rig is required to remove the casing at the depth of 20 feet below the mud line. After the casing is cut, the rig owner must cement the plug on the abandoned well to protect the marine life in the surrounding area.

To perform the cutting operation below the mud line, a cutting tool is lowered into the innermost casing, which usually has a relatively small diameter, and severs the tubulars. When the first inside casing is removed, another cutter with greater cutting diameter is lowered inside the pipe and the next diameter conduit is cut in a similar manner. This procedure continues until the multiple tubulars are cut at the required depth.

Conventionally, the industry uses a three-blade cutting tool, which will first cut the 7⅝" pipe, then another cutting tool that will cut 10¾", etc. If the inner casing collapses, the job becomes even more complicated and the casing needs to be drilled out or severed by an explosive to remove the smallest diameter casing. The conventional three-blade tool has cutter blades equidistantly spaced about the circumference of the tool body. The distance between the cutter blades in a conventional tool suitable for fitting into the smallest diameter pipe is relatively pipe is relatively small. The cutter blades have to be sufficiently small, as well, to allow lowering into the small diameter innermost tubular. The cutter blades of a conventional tool are often damaged, requiring pulling the tool to the surface and starting the process again. The painstaking process takes several days over the use of conventional tools.

If the inner casing collapsed, it may become completely impossible to mill out the necessary portions of the tubulars. In that case, the casing must be cut from the outside, first excavating the mud around the casing to the required depth and then applying the cutting tool to do the job. Such procedure is also expensive and takes several days.

The present invention contemplates elimination of the drawbacks associated with the prior art and provision of a casing cutter that can be used for cutting multiple tubulars in an efficient manner that allows to save time and expense of the operation.

SUMMARY OF THE INVENTION

It is, therefore, an object of the present invention to provide a casing cutter that can be used for severing multiple tubulars below the mud line.

It is another object of the present invention to provide a casing cutter that can be used for cutting various diameter tubulars that have been cemented together in an expeditious and relatively inexpensive manner.

It is still a further object of the present invention to provide an apparatus for severing multiple tubulars while using the same support body for carrying various length cutter knives while still fitting into the smallest diameter tubular.

These and other objects of the present invention are achieved through a provision of an apparatus and method for severing multiple tubulars in a well bore. The apparatus has a hollow support body of a generally cylindrical configuration and an outside diameter smaller than the inner diameter of the innermost of the tubulars. The support body has a longitudinal slot extending through diametrically opposite location of the support body.

A pair of strong cutter blades is pivotally mounted in relation to the support body; the cutter blades are recessed in the support body when the apparatus is in an idle position. A piston mounted in the support body moves in a vertical direction pushing the cutter blades and causing the cutter blades to pivot, while gradually extending through the slot of the support body into a contact with the tubulars.

A rotational force is applied to the support body, causing the cutter blades to sever the innermost of the multiple tubulars. The support body is then retrieved and a longer set of cutter blades is secured on the support body. Once lowered again into the well bore, the next set of the cutter blades extends to a greater distance and cuts through the next adjacent tubular. This process of lowering successively longer cutter blades continues until the outermost of the multiple tubulars is severed at a pre0determined depth.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 1:
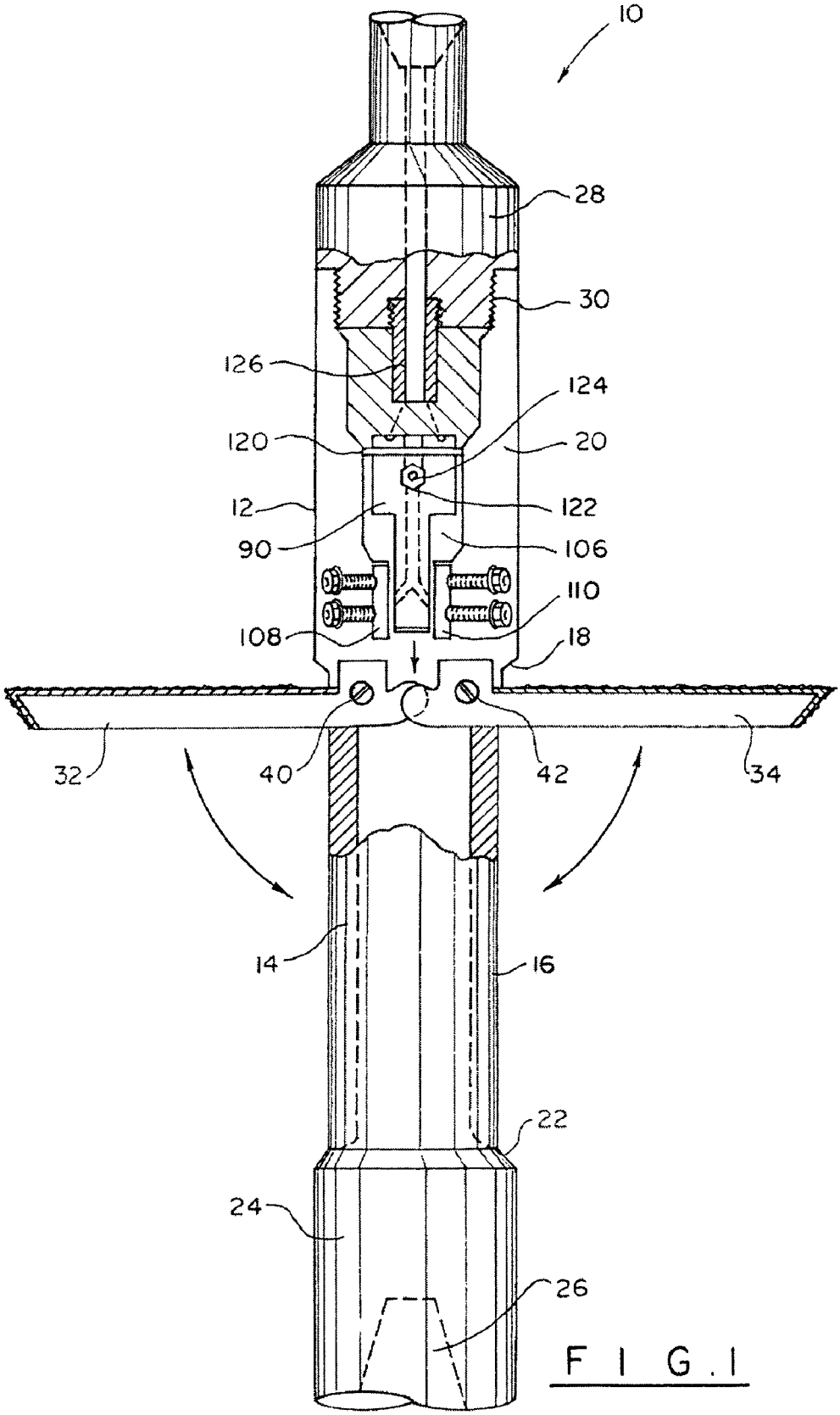
FIG. 1 is an elevation view of the preferred embodiment of the apparatus of the present invention shown with the blades fully extended.

Turning now to the drawings in more detail, numeral 10 designates the cutting tool in accordance with the present invention. The cutting apparatus 10 comprises a cutter body 12 configured as an elongated hollow body with a pair of longitudinal slots 14 and 16 formed in the side wall of the body 12. The slots 14 and 16 are open to the interior of the body 12, forming a through opening that communicates with diametrically opposite sides of the cylindrical side wall. An upper annular shoulder 18 is formed above the slots 14 and 16. An enlarged diameter portion 20 of the body 12 extends above the shoulder 18. A lower shoulder 22 is formed below the slots 14 and 16. An enlarged diameter lower portion 24 of the body 12 extends below the shoulder 22.

The lower portion 24 is provided with inner threads 26 for connecting the cutter body to tubular bodies positioned in the well below the apparatus 10. The upper portion 20 of the body 12 is adapted for detachable connection with a top bushing 28, which transmits rotational force to the body 12 from an outside source. The bushing 28 and the body 12 are connected by matingly engageable threads 30.

A pair of cutting blades, or knives 32 and 34 is pivotally secured to the support body 12. In an idle position, the blades extend in a generally parallel orientation in relation to the longitudinal axis of the body 12 and are recessed into the slots 14 and 16. Each of the cutter blades 32, 34 has an elongated, rectangular in cross section, configuration. Each cutter blade 32, 34 is provided with openings 36, 38, respectively for receiving pivot pins 40 and 42 therein. The knives 32, 34 have an upper surface 44, 46, respectively, which is encrusted with cutting chips 50 (FIG. 2) formed of hard non-corrosive material, for instance tungsten carbide.

Figure 2:
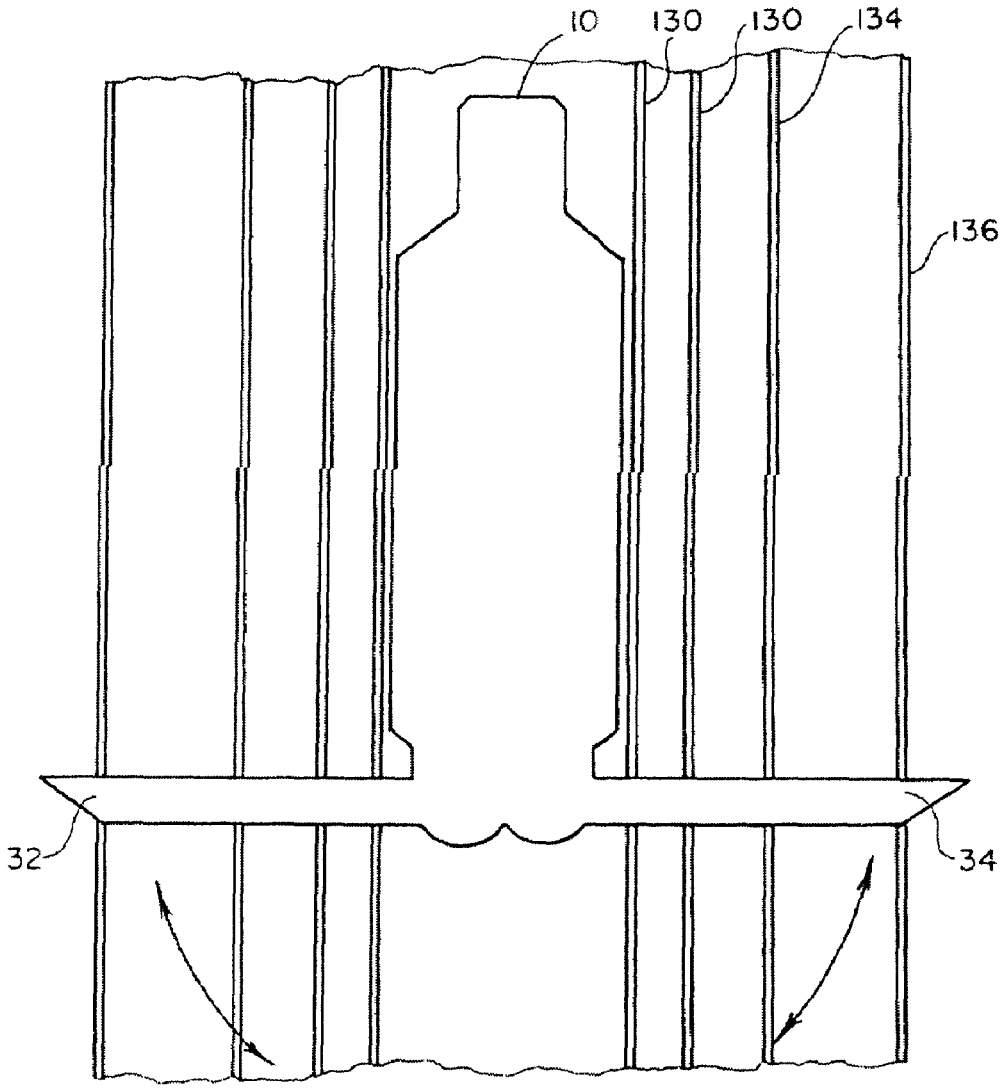
FIG. 2 is a schematic view illustrating position of the casing cutter of the present invention in a well bore with the cutter blades fully extended.
Figure 3:
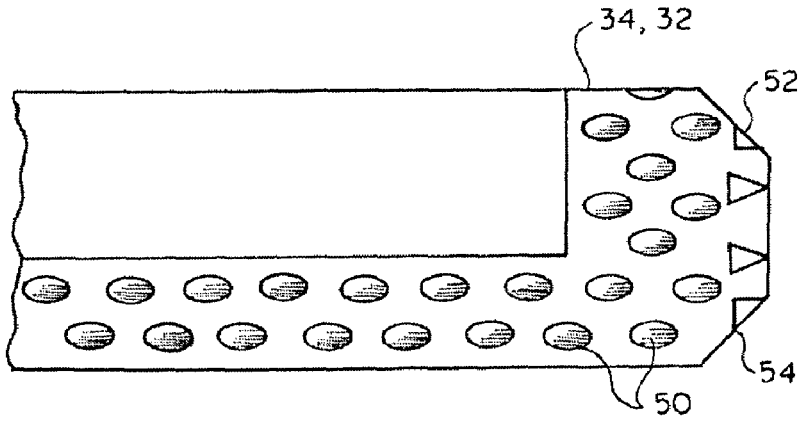
FIG. 3 is a detail view showing a portion of the cutter blade impregnated with cutting chips.
Figure 4:
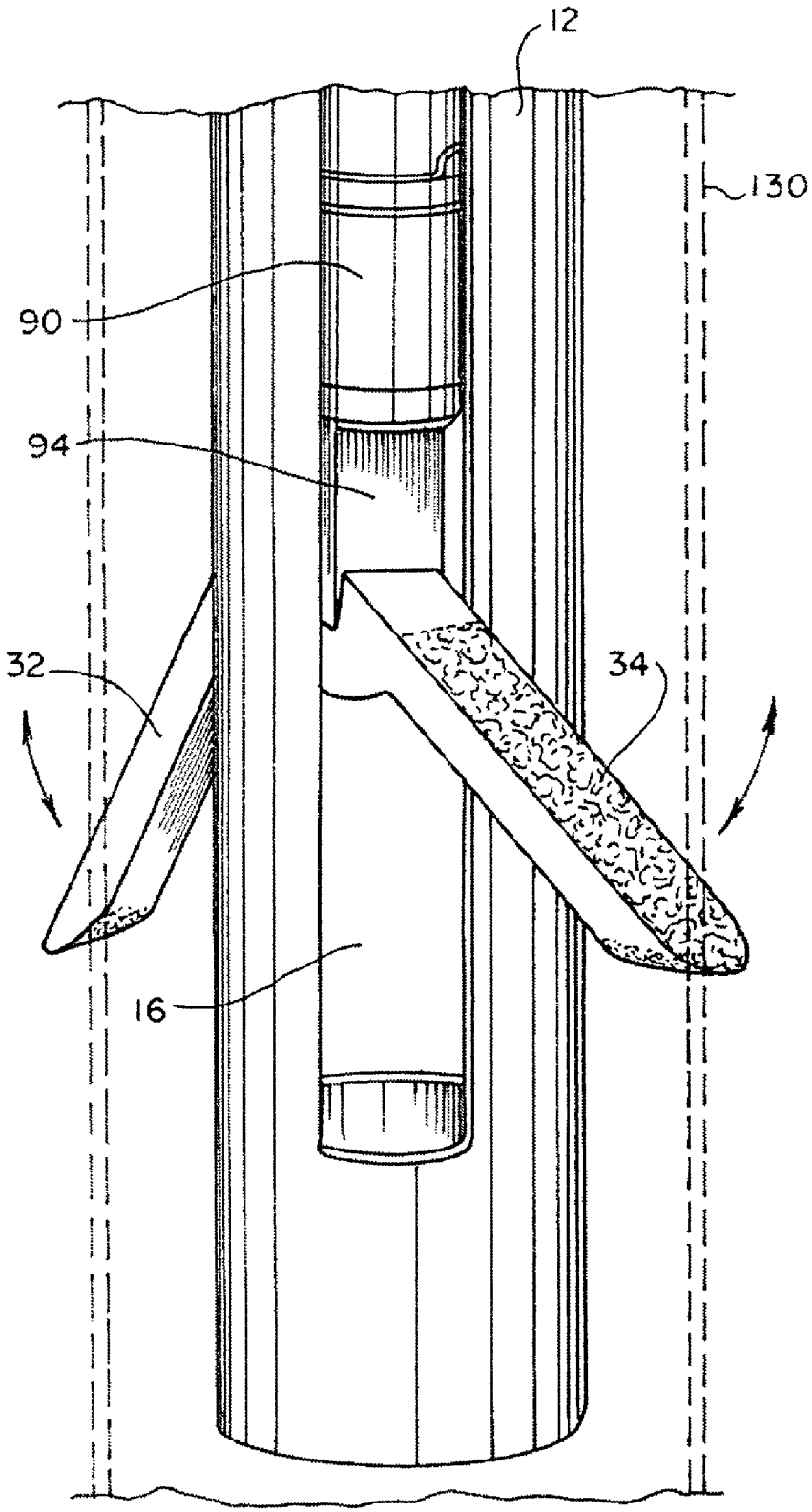
FIG. 4 is detail view showing cutter blades partially extended and cutting a window through a casing wall.
Figure 5:
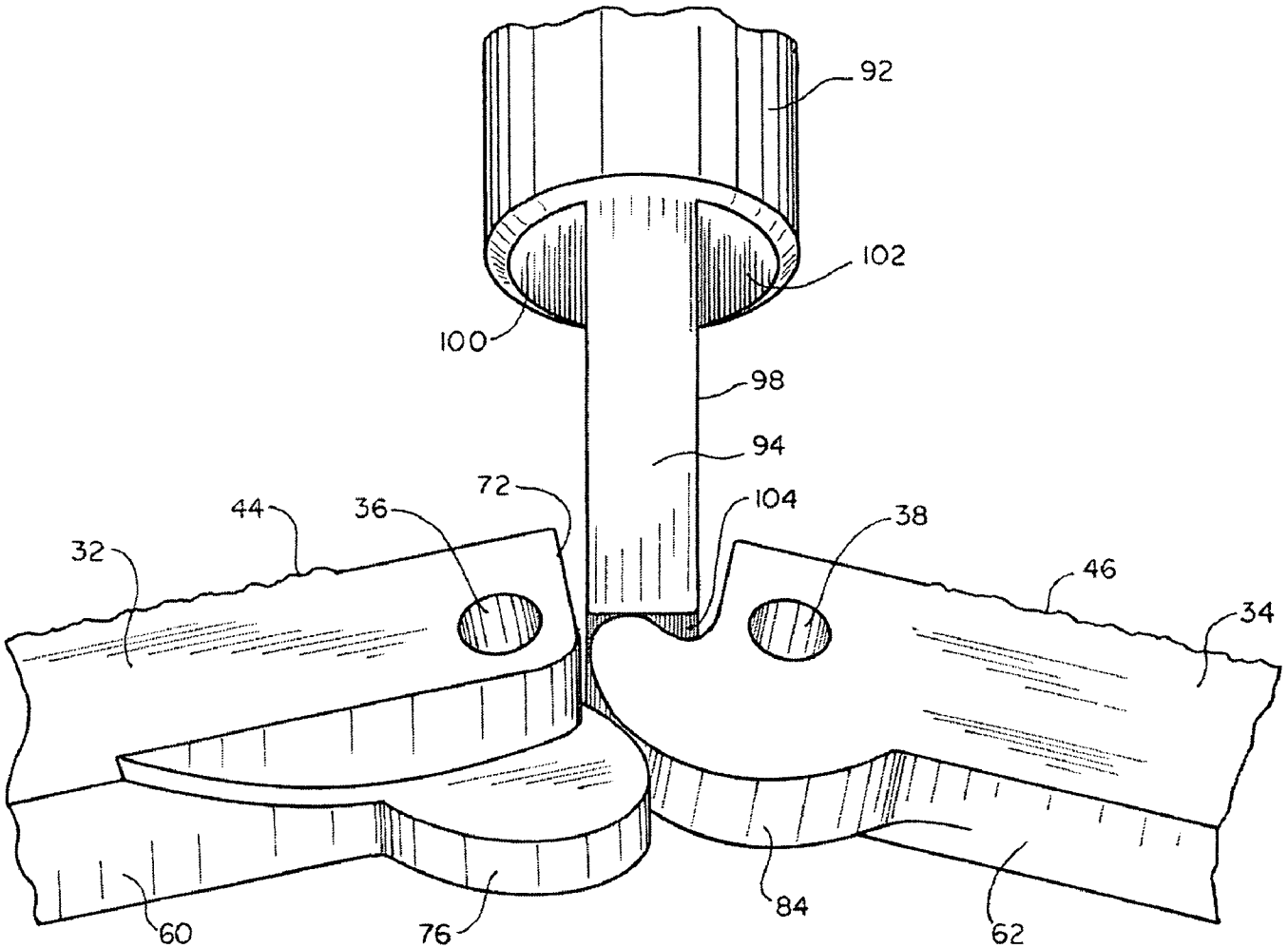
FIG. 5 is a detail view illustrating position of a piston assembly imparting a downward force on the proximate ends of the cutter blades.
Figure 6:
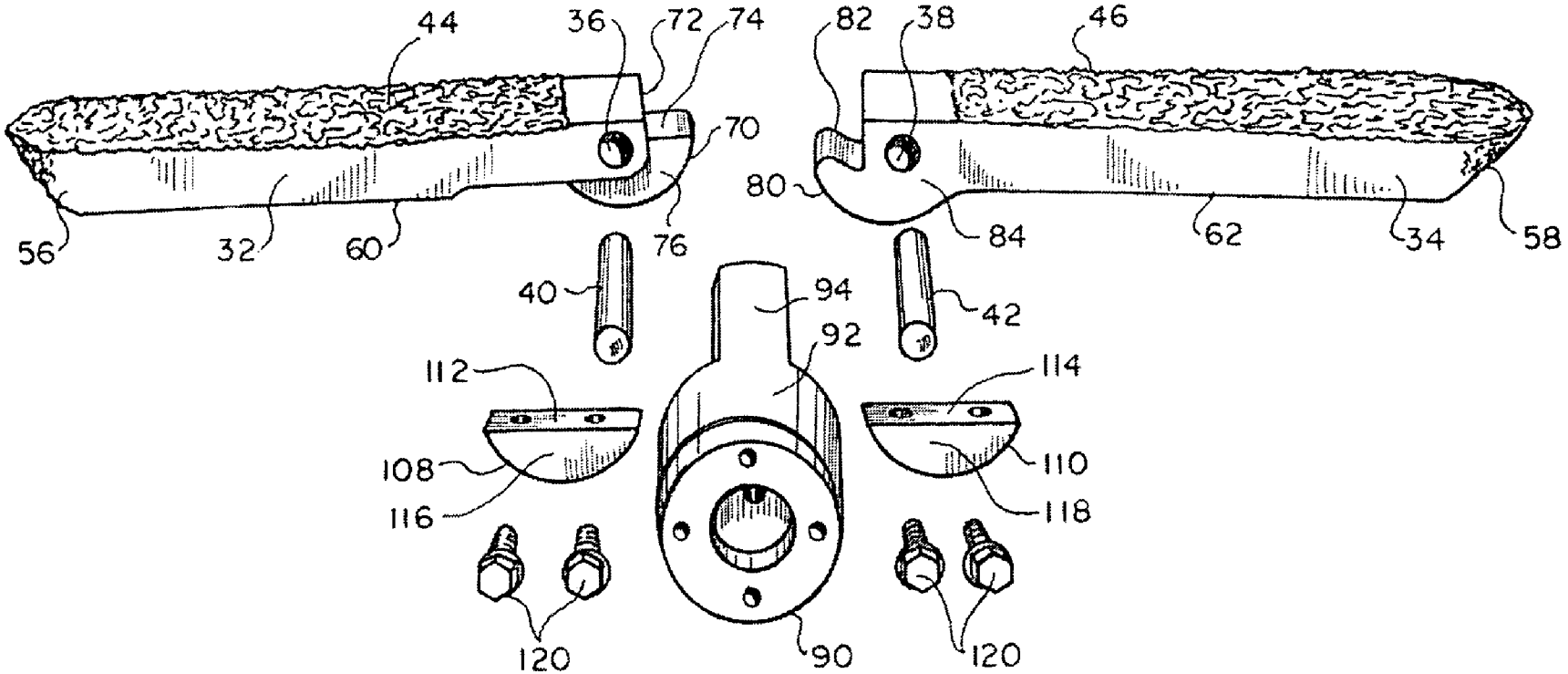
FIG. 6 is a detail view showing elements of the cutter blades and a piston assembly.

The distal end of each knife 32, 34 has angularly cut corners 52, 54 as shown in FIG. 2. Distal ends 56, 58 of the knives 32, 34 extend between the top surfaces 44, 46 to bottom surfaces 60, 62. The distal ends 56, 58 are encrusted with cutting chips 50 made of a strong non-corrosive material, such as tungsten carbide. The cutting surfaces of the distal ends 56 and 58 are oriented at an acute angle in relation to the upper surfaces 44, 46 and at an obtuse angle in relation to the bottom surfaces 60, 62.

A proximate end of the knife 32 has a "heel" portion 70 which extends forward of a vertical shoulder 72. The "heel" portion 70 has a width substantially smaller than the width of the remainder of the cutter blade 32. The heel portion 70 comprises a top surface 74 and a rounded part 76 extending below the upper surface 74. The pivot pin opening 36 extends through the heel portion 70 as well.

Figure 7:
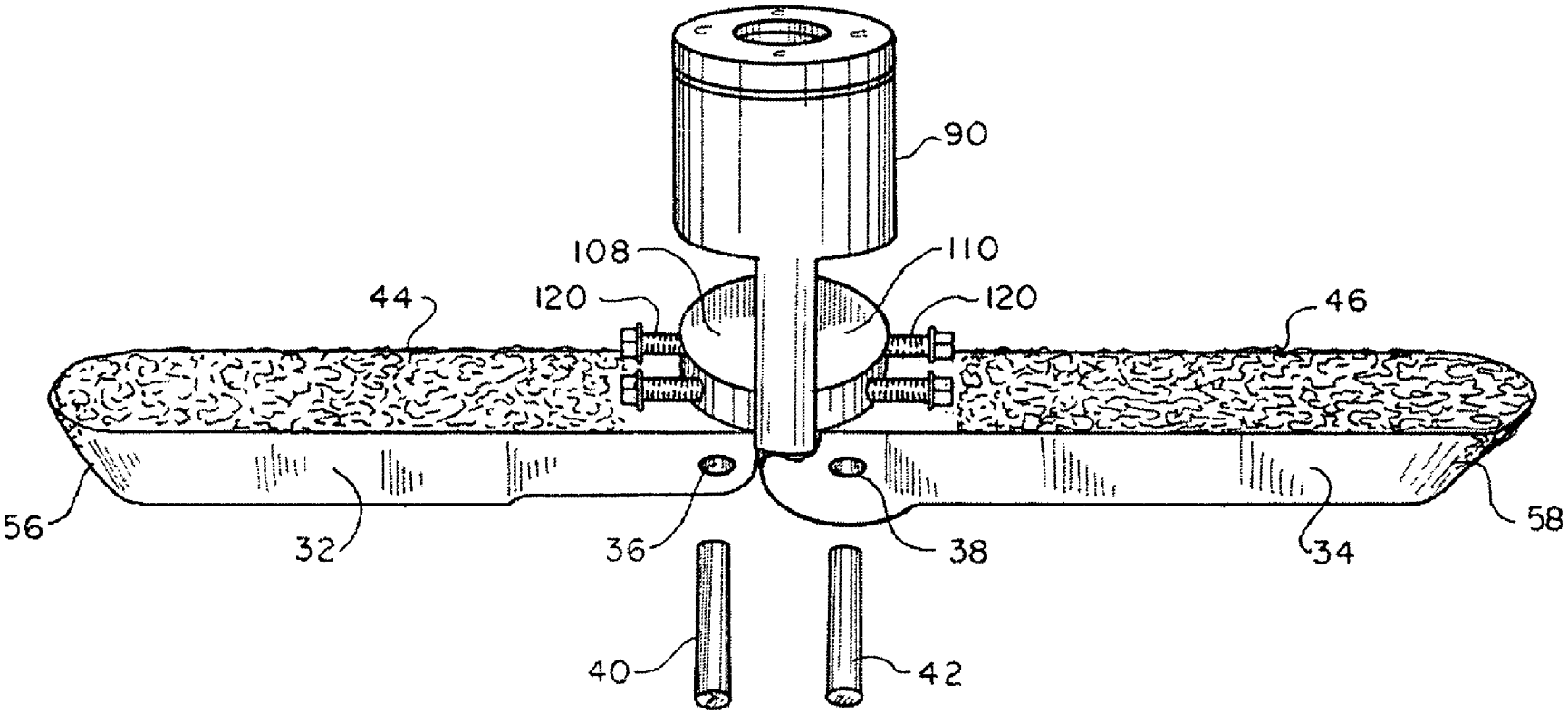
FIG. 7 is a detail view showing the cutter blades and the piston assembly, with the cutter blades oriented perpendicularly to a vertical axis of the piston assembly.

The knife 34 is a mirror image of the knife 32 and is similarly provided with a heel portion 80, which has a top surface 82 and a rounded part 84. When the cutter blades 32 and 34 are secured on the body 12, the heel portions 70 and 80 slightly overlap, as shown in FIGS. 1 and 7, due to the fact that the heel portions 70 and 80 have about ½ width of the remainder of the cutter blade bodies.

Apparatus 10 further comprises a means 90 for transmitting a downward force on the cutter blades 32, 34. The means 90 is a piston assembly, which has a piston body with an enlarged diameter upper portion 92 and a reduced size lower portion 94. The lower portion 94 is substantially rectangular in cross-section and is unitary connected to the upper portion 92. The upper portion 92 has a generally cylindrical configuration. The lower portion 94 has two side walls 96, 98 that extend below the upper portion 92 and terminate at the bottom surfaces 100 and 102 of the upper portion 92.

The bottom surface 104 of the portion 94 contacts the upper surfaces 74 and 82 of the heel portions 70 and 80, respectively, when the piston 90 moves in the downward direction within a central opening 106 of the body 12. The downward moving force applied to the piston assembly 90 may come from an electric, hydraulic, or pneumatic power source (not shown), to which the piston assembly 90 is connected in a manner known to those skilled in the art.

To ensure an axial movement of the piston assembly within the opening 106, the assembly 90 further comprises a pair of piston alignment blocks 108, 110. The piston alignment blocks are aligned to contact the surfaces 96 and 98 of the lower portion 94. The blocks 108 and 110 are configured as half disks, with straight surfaces 112, 114, and curved portions 116, 118. The piston alignment blocks 108 and 110 are secured to the piston assembly 90 with the help of tightening members or screws 120 (FIG. 12) such that the flat surfaces 112, 114 extend transversely to the flat surfaces 96 and 98 of the lower portion 94. The screws 120 extend through respective openings formed in the piston alignment blocks 108 and 110.

A sealing gasket 122 is mounted above the upper portion 92 of the piston assembly 90. The gasket 122 frictionally engages the interior walls of the opening 106 to seal off the area below and above the gasket 122. A bilge 124 and a snap ring 126 are located on the piston assembly 90 below the gasket 122. An upward movement of the piston assembly 90 is limited by a piston stop nipple 128 mounted in alignment with the central axis of the piston 90. The nipple 128 is threadably engaged with the top portion 28, as can be seen in FIG. 1.

In operation, the apparatus 10 is lowered into the smallest diameter pipe or casing 130 to a depth selected for performing the cutting operations. The required depth is such that the cutter blades 32 and 34 are positioned well below the mud line. In conventional oilfield operations the innermost casing 130 may have a diameter as small as 7⅝". The body of the apparatus 10 is caused to rotate within the casing 130, while the piston 90 presses downward on the heels 70 and 80 of the cutter blades 32, 34.

Under the influence of the downward force of the piston assembly 90, the cutter blades 32, 34 pivot about the pivot pins 40, 42, gradually extending through the slots 14 and 16 into a contact with the innermost tubular. The cutting surfaces of the distal ends 56, 58 begin the first cut through the casing 130. Eventually, a window of about 25 inches is cut through the wall of the casing 130 allowing the knives 32 and 34 to extend through the window.

Once the first casing is severed, the tool 10 is retrieved to the surface, and a longer set of cutter blades is secured on the support body 12. The longer set of the cutter blades still fits in the recesses formed by the slots 14 and 16. Once the tool is lowered to the depth where the new set of the cutter blades is aligned with the previously cut slot in the casing 130, rotational force is again applied to the body. At the same time, the new set of the cutter blades is extended through the pre-formed slot to continue the cutting operation through the next adjacent tubular and the cementing media.

Depending on the number of casings to be cut through, progressively longer blades are secured to the support body 12 and lowered into the well bore. The same support body 12 can carry the cutter blades for cutting large diameter tubulars, for instance a 30" casing. In such cases, the cutter blades 32, 34 are pivoted to extend almost perpendicularly to the longitudinal axis of the support body 12 to a position schematically shown in FIG. 1.

As is illustrated in FIG. 2, the cutter blades of the apparatus of the present invention can cut through a wall of the smallest diameter casing 130. Longer blades 32, 34 when acted upon by the piston assemblym90, extend at a less acute angle in relation to the vertical axis of the body 12. In this position the blades 32, 34 sever the next diameter tubular 132. Still longer blades, when forced to extend at an almost straight angle in relation to the vertical axis of the body 12 cut through the casing 134.

This process continues until the outermost casing 136 (if there are more than three cemented casings) is severed. When the entire set of multiple tubulars has been severed, the apparatus 10 is withdrawn and cementing of the below-the-surface portion of the casing string is performed in a conventional manner.

The apparatus of the present invention allows severing of multiple casings that are cemented together using a two-bladed cutter. The support body 12 fits within the narrowest casings, while carrying cutter blades to cut even large diameter casings. The initial cut with the shortest set of knives 32, 34 is used for extending longer knife blades through the window and continue cutting operations at the same depth, while continuously increasing the lengths of the blades 32, 34 until the most outside casing is severed.

In comparison with conventional methods, the apparatus of the present invention allows to eliminate the milling from an outside of the casings, while severing the multiple tubulars at the desired depth in the matter of 1½ to 2 days. The apparatus of the rpesent invention allows severing of the multiple tubulars even when the tubulars are not co-axially aligned.

The cutting blade of the present invention allows cutting with the ends of the cutter blades 56, 58 and with the top surfaces 44, 46 of the blade. In conventional three bladed cutters, the knives are about 1 inch wide. With the two bladed cutter of the present invention, the cutter blades can be up to 3 inches wide, which makes them stronger and allows to reach out into the outermost casing. The cutter blades 32 and 34 are heat treated to withstand considerable friction forces when cutting through the cemented casings.

Many other changes and modifications may be made in the design of the present invention without departing from the spirit thereof. I, therefore, pray that my rights to the present invention be limited only by the scope of the appended claims.

I claim:

1. An apparatus for severing multiple tubulars in a well bore, comprising:

an elongated hollow body adapted for receiving torque from an external rotational source;

a pair of cutter blades pivotally mounted in said body for cutting through walls of the tubulars, said cutter blades comprising a main top surface and a distal end wall, and wherein cutting elements are located on said main top surface and said distal end wall; and a means for gradually pivotally moving the cutter blades from an idle position recessed in the hollow body to a position substantially perpendicular to the vertical axis of the body; and a means for lowering said body into a well bore.

2. The apparatus of claim 1, wherein each of said cutter blades comprises a proximate end, and wherein a heel portion is formed on said proximate end.

3. The apparatus of claim 2, wherein said heel portion comprises a curved portion and a substantially straight heel upper surface, the heel upper surface being at a different plane with said main top surface.

4. The apparatus of claim 3, wherein the heel upper surface has a width substantially smaller than a width of the main top surface of the cutter blade.

5. The apparatus of claim 2, wherein said means for pivotally moving the cuter blades comprises a piston assembly, which applies a downward force on heel portions of said cutter blades and causes the cutter blades to move outside of the body into a contact with the tubulars.

6. The apparatus of claim 5, wherein said piston assembly comprises a piston body and a pair of alignment members positioned adjacent a lower portion of the piston body to ensure alignment of the piston body within the hollow body.

7. The apparatus of claim 6, wherein said piston body comprises an upper portion for receiving a downward force from an exterior power source and a lower portion, a bottom surface of the lower portion urging against the cutter blades adjacent to a pivot point of each of the cutter blades.

8. The apparatus of claim 6, further comprising a means for limiting upward movement of the piston body within the hollow body.

9. The apparatus of claim 8, wherein said piston movement limiting means comprises a nipple member detachably engaged with said means for lowering the hollow body.

10. The apparatus of claim 6, wherein said piston body comprises a generally cylindrical upper part and a generally rectangular lower part integrally connected to the upper part, wherein said alignment members comprise a pair of blocks detachably secured on opposite sides of the lower part.

11. The apparatus of claim 2, wherein a proximate end of each of the cutter blades receives a pivot pin therein.

12. The apparatus of claim 1, wherein said hollow body has a side wall, and wherein a cutout is formed in the side wall for receiving the cutter blades therein when the cutter blades are in an idle position.

13. The apparatus of claim 1, wherein said means for lowering the hollow body into the well bore comprises a top bushing detachably engageable with a top of the hollow body.

14. An apparatus for severing multiple tubulars in a well bore, comprising: a hollow support body adapted for lowering into a well bore; at least one longitudinal blade slot through said support body, to allow passage of a pair of cutter blades in opposite directions therethrough; and a vertical force transfer element mounted in said support body, for transferring downward vertical force from an external power source to the cutter blades and causing the cutter blades to extend outwardly from said support body, said vertical force transfer element comprising a piston and wherein a pair of alignment members are positioned adjacent a lower portion of the piston to ensure alignment of the piston when the vertical force is applied to the piston.

15. The apparatus of claim 14, wherein each of said cutter blades comprises a main top surface and a distal end wall, and wherein cutting elements are located on said main top surface and said distal end wall.

16. The apparatus of claim 15, wherein each of said cutter blades comprises a proximate end, and wherein a heel portion is formed on said proximate end.

17. The apparatus of claim 16, wherein said heel portion comprises a curved portion and a substantially straight heel upper surface, the heel upper surface being at a different plane with said main top surface.

18. A method of severing multiple tubulars in a well bore, comprising the steps of: providing a hollow support body carrying a pair of pivotally moveable first set of a pair of cutter blades; providing a means for applying pivotal force on the cutter blades and for moving the cutter blades outwardly from the support body; lowering the support body into the innermost of said multiple tubulars; applying rotational force to said support body, while applying a downward force on the cutter blades, thereby causing the cutter blades to cut through a wall of the innermost of the multiple tubulars, each of said cutter blades having an end and an upper surface, and wherein cutting elements are positioned on said end and said upper surface.

19. The method of claim 18, further comprising the steps of:

retrieving the support body and substituting the first set of the cutter blades with a second set of the cutter blades of greater longitudinal dimension; lowering the support body into the innermost of said multiple tubulars;

applying rotational force to said support body, while applying a downward force on the cutter blades, thereby causing the cutter blades to extend through the slot formed by the first set of the cutter blades and cut through a wall of the next adjacent of the multiple tubulars.

20. The method of claim 19, further comprising the steps of repeating the steps of substituting the first set of the pair of cutter blades with progressively longer cutter blades until the outermost of the multiple tubulars has been severed.

21. The method of claim 18, further comprising a step of providing a means for applying a downward force on proximate ends of the cutter blades.

22. The method of claim 21, wherein said step of providing a means for applying a downward force comprises a step of providing a piston and wherein a pair of alignment members are positioned adjacent a lower portion of the piston to ensure alignment of the piston when the downward force is applied to the cutter blades.

23. The method of claim 18, further comprising a step of providing a pair of cutter blades, each cutter blade comprising a proximate end, and forming a heel portion on said proximate end.

24. The method of claim 23, further comprising a step of forming a curved portion and a substantially straight heel upper surface in each of said cutter blades, and wherein the heel upper surface is being located at a different plane with a main top surface of the cutter blade.

* * * * *